US007565100B2

(12) United States Patent
Namba

(10) Patent No.: US 7,565,100 B2
(45) Date of Patent: Jul. 21, 2009

(54) ELECTROPHOTOGRAPHIC APPARATUS AND INTERMEDIATE TRANSFER MEMBER PARTITIONED BY MULTIPLE SLITS

(75) Inventor: Haruyuki Namba, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 427 days.

(21) Appl. No.: 11/497,380

(22) Filed: Aug. 2, 2006

(65) Prior Publication Data

US 2007/0237553 A1 Oct. 11, 2007

(30) Foreign Application Priority Data

Apr. 11, 2006 (JP) ..... 2006-108410

(51) Int. Cl.
*G03G 15/01* (2006.01)

(52) U.S. Cl. ..... 399/302

(58) Field of Classification Search ..... 399/298, 399/299, 302, 303

See application file for complete search history.

(56) References Cited

U.S. PATENT DOCUMENTS 7,266,329 B2 * 9/2007 Matsuo et al. ..... 399/302
7,346,295 B2 * 3/2008 Mochimaru ..... 399/303
2005/0141920 A1 6/2005 Sato et al.

FOREIGN PATENT DOCUMENTS

JP A 2004-191659 7/2004
JP A 2005-195679 7/2005

* cited by examiner

*Primary Examiner*—William J Royer
(74) *Attorney, Agent, or Firm*—Oliff & Berridge, Plc.

(57) ABSTRACT

An image forming apparatus including an image carrier on which a toner image is formed, a charging unit that charges a surface of the image carrier, a latent image processing unit that forms a latent image on the surface of the image carrier, a developing unit that develops the latent image using a toner, thereby forming a toner image, a primary transfer unit that conducts a primary transfer of the toner image to an intermediate transfer member, and a secondary transfer unit that conducts a secondary transfer of the toner image that has been transferred to the intermediate transfer member to a transfer target, wherein a surface of the intermediate transfer member is partitioned by multiple slits.

17 Claims, 5 Drawing Sheets

ELECTROPHOTOGRAPHIC APPARATUS AND INTERMEDIATE TRANSFER MEMBER PARTITIONED BY MULTIPLE SLITS

BACKGROUND

1. Technical Field

The present invention relates to an image forming apparatus and an intermediate transfer member.

2. Related Art

Image forming apparatus in which a color image is formed by using an intermediate transfer member such as an intermediate transfer belt to electrostatically transfer toner are well known. When an image is formed on a sheet of paper using such an intermediate transfer member, four color images in yellow, magenta, cyan and black respectively are generally first transferred sequentially from an image carrier such as a photoreceptor and superimposed on the intermediate transfer member (the primary transfer), and this full color image is then transferred to a sheet of paper in a single step (the secondary transfer).

The types of paper that can be used within these image forming apparatus vary considerably, from paper with a smooth surface through to so-called embossed paper that includes unevenness within the paper surface. With uneven papers, a gap develops between the paper and the surface of the intermediate transfer member at indentations within the paper, and electrical discharge causes the toner formed on the surface of the intermediate transfer member to develop an inverse charge, which may result in unsatisfactory transfer. Particularly in systems that employ an intermediate transfer member, the toner that has been previously transferred by the primary transfer process gradually accumulates more charge as a result of transfer field effects and electrical discharge, meaning a large electric field is then required in the secondary transfer process to transfer this highly charged toner, and this may also exacerbate transfer problems to uneven papers.

In order to achieve a favorable transfer to an uneven paper with no transfer irregularities, the gaps that develop between the paper and the surface of the intermediate transfer member at the indentations within the paper should be eliminated as far as possible.

SUMMARY

According to an aspect of the present invention, there is provided an image forming apparatus including an image carrier on which a toner image is formed, a charging unit that charges a surface of the image carrier, a latent image processing unit that forms a latent image on the surface of the image carrier, a developing unit that develops the latent image using a toner, thereby forming a toner image, a primary transfer unit that conducts a primary transfer of the toner image to an intermediate transfer member, and a secondary transfer unit that conducts a secondary transfer of the toner image that has been transferred to the intermediate transfer member to a transfer target, wherein a surface of the intermediate transfer member is partitioned by multiple slits.

BRIEF DESCRIPTION OF THE DRAWINGS

Embodiment(s) of the present invention will be described in detail based on the following figures, wherein.

DETAILED DESCRIPTION OF EMBODIMENTS

As follows is a description of exemplary embodiments of the present invention.

Figure 1:
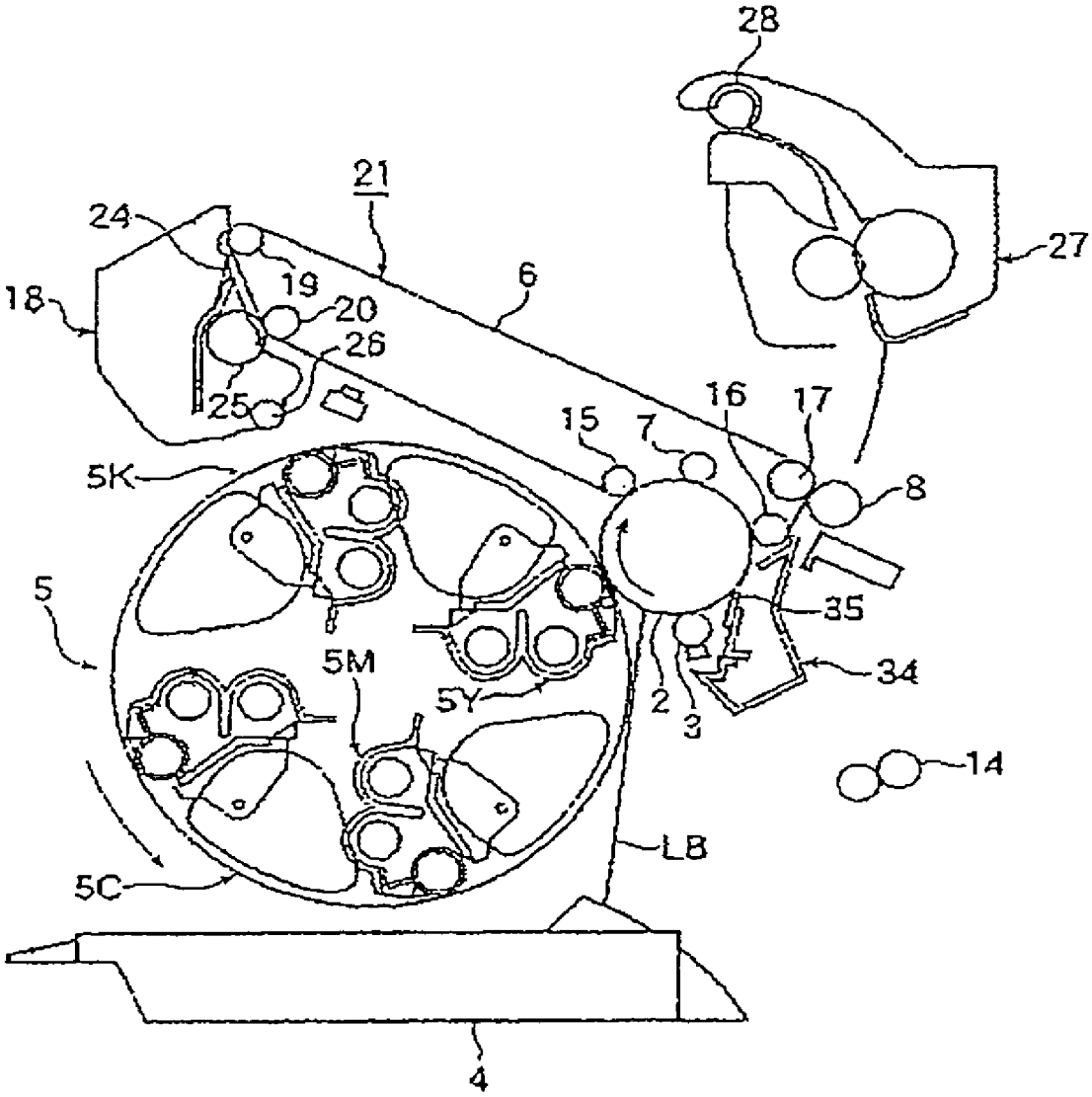
FIG. 1 is a schematic structural view showing an image forming section of a 4-cycle full color printer that represents an example of an image forming apparatus according to an exemplary embodiment of the present invention.
Figure 2:
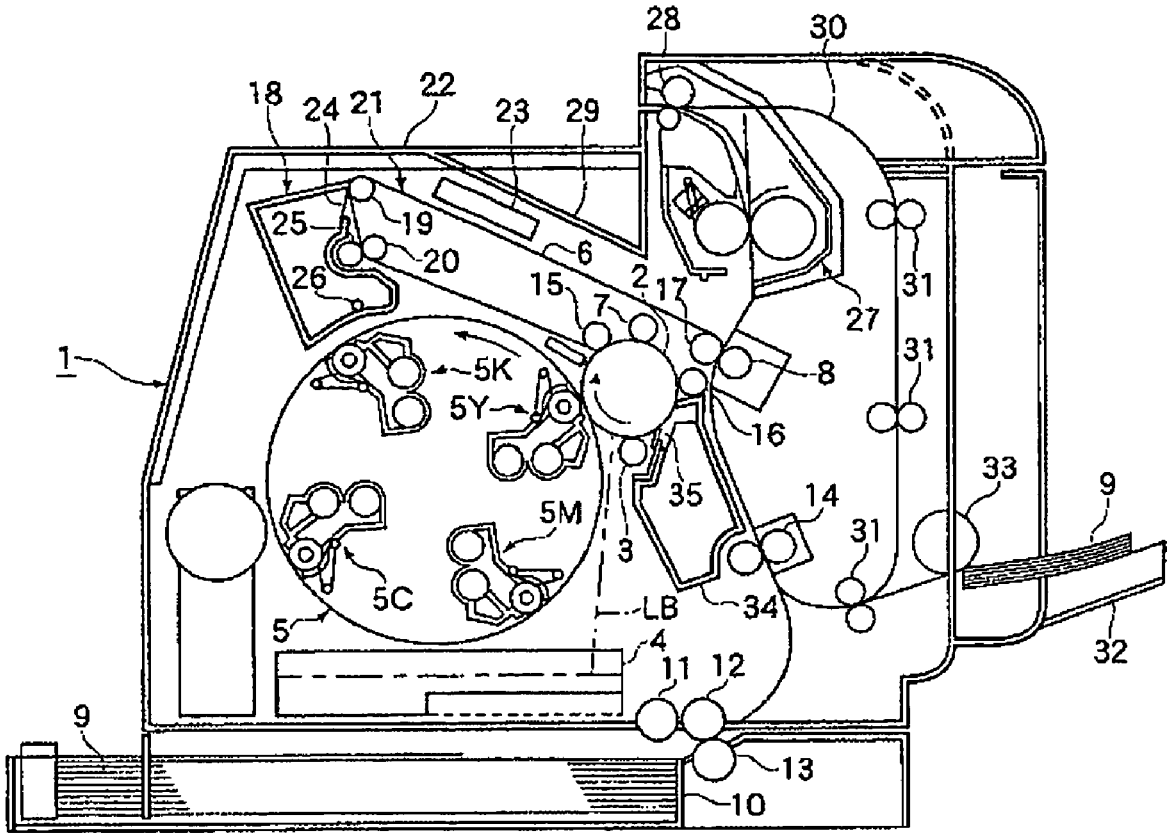
FIG. 2 is an overall schematic structural view showing a 4-cycle full color printer that represents an example of an image forming apparatus according to an exemplary embodiment of the present invention.

FIG. 1 is a schematic structural view showing an image forming section of a 4-cycle full color printer that represents an example of an image forming apparatus according to an exemplary embodiment of the present invention, and FIG. 2 is an overall schematic structural view showing a 4-cycle full color printer that represents an image forming apparatus according to an exemplary embodiment of the present invention. In a 4-cycle color image forming apparatus, toner images of different colors such as yellow, magenta, cyan and black are formed sequentially on a single photoreceptor drum, and following the primary transfer and superimposing of these toner images onto an intermediate transfer member, the toner image made up of this multiple of yellow, magenta, cyan and black images that have been transferred to the intermediate transfer member undergoes a secondary transfer to a recording sheet using a secondary transfer roller, thereby forming a full color image.

The image forming apparatus of an exemplary embodiment of the present invention is not restricted to a 4-cycle color image forming apparatus, and a tandem-type color image forming apparatus are also possible, wherein toner images of different colors such as yellow, magenta, cyan and black are formed on multiple (for example, four) photoreceptors, and following the primary transfer and superimposing of these images onto an intermediate transfer member, the toner image made up of this multiple of yellow, magenta, cyan and black images that have been transferred to the intermediate transfer member undergoes a secondary transfer to a recording sheet using a secondary transfer roller, thereby forming a full color image.

An image forming apparatus 1 shown in FIG. 2 includes a photoreceptor drum 2 as the image carrier on which an electrostatic latent image is formed, a charging roller 3 as the charging unit that charges the surface of the photoreceptor drum 2, a drive unit (not shown in the drawing) that rotationally drives the photoreceptor drum 2, an exposure device 4 as the latent image processing unit that forms an electrostatic latent image on the surface of the photoreceptor drum 2, a developing device 5 as the developing unit that adheres toner to the electrostatic latent image formed on the surface of the photoreceptor drum 2, thereby forming a toner image, an intermediate transfer belt 6 that functions as the intermediate transfer member, which is driven by the photoreceptor drum 2, and to which each colored toner image developed sequentially on the photoreceptor drum 2 is transferred and superimposed through a primary transfer process, a primary transfer roller 7 as the primary transfer unit that effects the primary transfer of each colored toner image developed sequentially on the photoreceptor drum 2 to the intermediate transfer belt 6, a secondary transfer roller 8 as the secondary transfer unit that effects the secondary transfer of the toner image from the intermediate transfer belt 6 to a recording sheet (a transfer target) 9 in a single step, and a cleaning device 18 as the cleaning unit that removes any residual toner from the surface of the intermediate transfer belt 6.

Next is a description of the operation of the image forming apparatus 1 according to an exemplary embodiment of the present invention. In FIG. 2, the photoreceptor drum 2 that functions as the image carrier is disposed inside the image forming apparatus 1, in a position slightly right and above of center, and in a manner that enables the photoreceptor drum 2 to be rotated. The photoreceptor drum 2 is rotationally driven in the direction of the arrow using a drive unit that is not shown in the drawing. As shown in FIG. 1, the surface of the photoreceptor drum 2 is charged with a predetermined potential using the charging roller 3 that functions as the charging unit, which is positioned substantially directly below the photoreceptor drum 2. Subsequently, a ROS (Raster Output Scanner), which functions as the exposure device 4 and is positioned in a slightly distant position directly below the photoreceptor drum 2, is used to perform an image exposure with a laser beam (LB), thereby forming an electrostatic latent image that corresponds with the image information. The electrostatic latent image formed on the photoreceptor drum 2 is then developed by the rotational developing device 5, which contains developing sections 5Y, 5M, 5C and 5K corresponding with each of the colored toners, namely yellow (Y), magenta (M), cyan (C) and black (K) respectively, disposed around the circumference, thereby forming a toner image of a predetermined color.

The steps of charging, exposing and developing the surface of the photoreceptor drum 2 are conducted once for the image corresponding with each color. The rotational developing device 5 is rotated with a predetermined timing, so that the developing section 5Y, 5M, 5C or 5K corresponding with the color currently undergoing developing is positioned in the developing position opposing the photoreceptor drum 2. For example, in the case of the formation of a full color image, the steps of charging, exposing and developing the surface of the photoreceptor drum 2 are each conducted four times, once for each of the four colors, namely yellow (Y), magenta (M), cyan (C) and black (K), thereby sequentially forming a toner image of yellow (Y), magenta (M), cyan (C) and black (K) respectively on the surface of the photoreceptor drum 2. The number of times the photoreceptor drum 2 is rotated during formation of a toner image varies depending on the image size. For example, in the case of an A4 image, the photoreceptor drum 2 is rotated three times to form a single color image. In other words, every three times the photoreceptor drum 2 is rotated, a toner image corresponding with the yellow (Y), magenta (M), cyan (C) or black (K) image is formed sequentially on the surface of the photoreceptor drum 2. The toner images formed sequentially on the photoreceptor drum 2 pass through a primary transfer position and are superimposed on the intermediate transfer belt 6 via the primary transfer process described below.

The yellow (Y), magenta (M), cyan (C) and black (K) toner images formed sequentially on the photoreceptor drum 2 undergo primary transfer at the primary transfer position where the intermediate transfer belt 6 that functions as the intermediate transfer member is wrapped around the outer periphery of the photoreceptor drum 2. The primary transfer is conducted using the primary transfer roller 7, and superimposes the different color toner images on top of the intermediate transfer belt 6. The multiple toner images of yellow (Y), magenta (M), cyan (C) and black (K) transferred to the surface of the intermediate transfer belt 6 then undergo a single step secondary transfer, using the secondary transfer roller 8, onto the recording sheet 9 which is supplied at a predetermined timing. The secondary transfer roller 8 may either be driven through contact with the intermediate transfer belt 6, or may be rotationally driven via a gear using a drive source not shown in the drawing. In such a case, in order to ensure that no differences in speed of movement develop between the secondary transfer roller 8 and the intermediate transfer belt 6, the secondary transfer roller 8 is preferably rotationally driven via a torque limiter so that if the rotational speed of the secondary transfer roller 8 becomes overly fast, it is able to idle.

As shown in FIG. 2, the recording sheet 9 is supplied from a paper supply section 10 positioned at the bottom of the image forming apparatus 1 and is fed out by a pickup roller 11. The paper is then supplied one sheet at a time using a feed roller 12 and a retard roller 13, and is transported to the secondary transfer position of the intermediate transfer belt 6 using resist rollers 14, under timing that coincides with the toner image transferred to the intermediate transfer belt 6. Furthermore, the secondary transfer roller 8 is designed to make contact with, and then separate from, the intermediate transfer belt 6 at predetermined timings. The secondary transfer roller 8 functions as a loading unit, and the region over which the loading unit contacts the intermediate transfer belt 6 is positioned close to the downstream side of the photoreceptor drum 2. As described below, the drive speed of the photoreceptor drum 2 can be either reduced or increased in accordance with the timing with which this loading unit contacts the intermediate transfer belt 6.

As shown in FIG. 1, the intermediate transfer belt 6 is held under tension by multiple rollers, and is designed to be driven by the rotation of the photoreceptor drum 2, thereby revolving at a predetermined process speed. The intermediate transfer belt 6 is supported under a predetermined level of tension by a wrap-in roller 15, which specifies a wrap position for the intermediate transfer belt 6 on the upstream side of the rotational direction of the photoreceptor drum 2, the primary transfer roller 7 which transfers the toner image formed on the photoreceptor drum 2 to the intermediate transfer belt 6, a wrap-out roller 16, which specifies a wrap position for the intermediate transfer belt 6 on the downstream side of the wrap location, a backup roller 17 that contacts the secondary transfer roller 8 across the intermediate transfer belt 6, a first cleaning backup roller 19 that opposes the cleaning device 18 for the intermediate transfer belt 6, and a second cleaning backup roller 20.

Furthermore, the intermediate transfer belt 6 is held under tension by the multiple rollers 7, 15, 16, 17, 19 and 20, and in the exemplary embodiment shown, the cross-section of the intermediate transfer belt 6 is a flattened and elongated substantially trapezoidal shape that enables a reduction in size of the main body of the image forming apparatus 1.

As shown in FIG. 2, in an exemplary embodiment of the present invention, although the overall size of the image forming apparatus 1 is kept as small as possible, the rotational developing device 5 occupies a large space within the main body of the image forming apparatus 1. Accordingly, the main body of the image forming apparatus 1 is designed so as to achieve maximum miniaturization of the image forming apparatus 1, while also improving the ease with which maintenance may be performed on the intermediate transfer belt 6 and the rotational developing device 5 and the like. Specifically, the intermediate transfer belt 6, including the photoreceptor drum 2, the charging roller 3 and the secondary transfer roller 8 form a single integrated image forming unit 21, which is able to be freely inserted in, or removed from, the main body of the image forming apparatus 1 by opening a top cover 22 provided in the main body of the image forming apparatus 1. Furthermore, a density sensor 23 formed from a reflective photosensor, which detects the patch density of toner formed on the surface of the intermediate transfer belt 6, is positioned above the intermediate transfer belt 6.

As shown in FIG. 1, the cleaning device 18 for the intermediate transfer belt 6 includes a scraper 24, which is positioned so as to contact the surface of the intermediate transfer belt 6 as it is held under tension by the first cleaning backup roller 19, and a cleaning brush 25 which is positioned so as to press against the surface of the intermediate transfer belt 6 as it is held under tension by the second cleaning backup roller 20. Any residual toner or paper dust or the like removed by the scraper 24 and cleaning brush 25 is collected within the cleaning device 18. The cleaning device 18 is supported in a manner that enables the entire cleaning device 18 to pivot about a pivot shaft 26 in an anticlockwise direction as shown in the drawing, and consequently the cleaning device 18 can be retracted to a position distant from the surface of the intermediate transfer belt 6, and then swung back to contact the intermediate transfer belt 6 at a predetermined timing. The cleaning device 18 functions as a loading unit, and the region over which the loading unit contacts the intermediate transfer belt 6 is positioned close to the upstream side of photoreceptor drum 2. As described below, the drive speed of the photoreceptor drum 2 can be either increased or reduced in accordance with the timing with which the loading unit contacts the intermediate transfer belt 6.

The secondary transfer roller 8 and the cleaning device 18 function as loading units, which impart load to the intermediate transfer belt 6 by contacting the surface of the intermediate transfer belt 6 at predetermined timings. The load on the intermediate transfer belt 6 is varied by making either one of, or both, the secondary transfer roller 8 and the cleaning device 18 make contact with, or retract from, the intermediate transfer belt 6.

In addition, as shown in FIG. 2, the recording sheet 9 to which the toner image from the intermediate transfer belt 6 has been transferred is then transported to a fixing unit 27, the fixing unit 27 uses heat and pressure to fix the toner image to the recording sheet 9, and in the case of single-sided printing, the recording sheet 9 is then discharged by a discharge roller 28 to a discharge tray 29 provided at the top of the main body of the image forming apparatus 1.

In the case of double-sided printing, the recording sheet 9 bearing the toner image that has been fixed by the fixing unit 27 is not simply discharged by the discharge roller 28 to the discharge tray 29, but rather, the rear edge of the recording sheet 9 is nipped by the discharge roller 28, and the discharge roller 28 is then rotated in reverse, while the transport path for the recording sheet 9 is switched to a double-sided sheet transport path 30. Transport rollers 31 disposed along this double-sided sheet transport path 30 then transport the recording sheet 9 back to the secondary transfer position of the intermediate transfer belt 6 with the paper inverted, enabling the rear surface of the recording sheet 9 to undergo image formation.

Moreover, as shown in FIG. 2, the image forming apparatus 1 also includes, as an option, a manual feed tray 32, which can be opened and closed freely and is provided in the side of the main body of the image forming apparatus 1. A recording sheet 9 of arbitrary size and type placed on the manual feed tray 32 is fed into the image forming 1 by a feed roller 33, and is transported to the secondary transfer position of the intermediate transfer belt 6 by the transport rollers 31 and the resist rollers 14, thereby enabling image formation to be conducted onto the recording sheet 9 of arbitrary size and type.

Following completion of the toner image transfer process, the surface of the photoreceptor drum 2 is cleaned with each rotation of the photoreceptor drum 2 by a cleaning blade 35 of a cleaning device 34 that is positioned diagonally below the photoreceptor drum 2, thereby removing residual toner and the like and preparing the photoreceptor drum 2 for the next image forming step.

Figure 3:
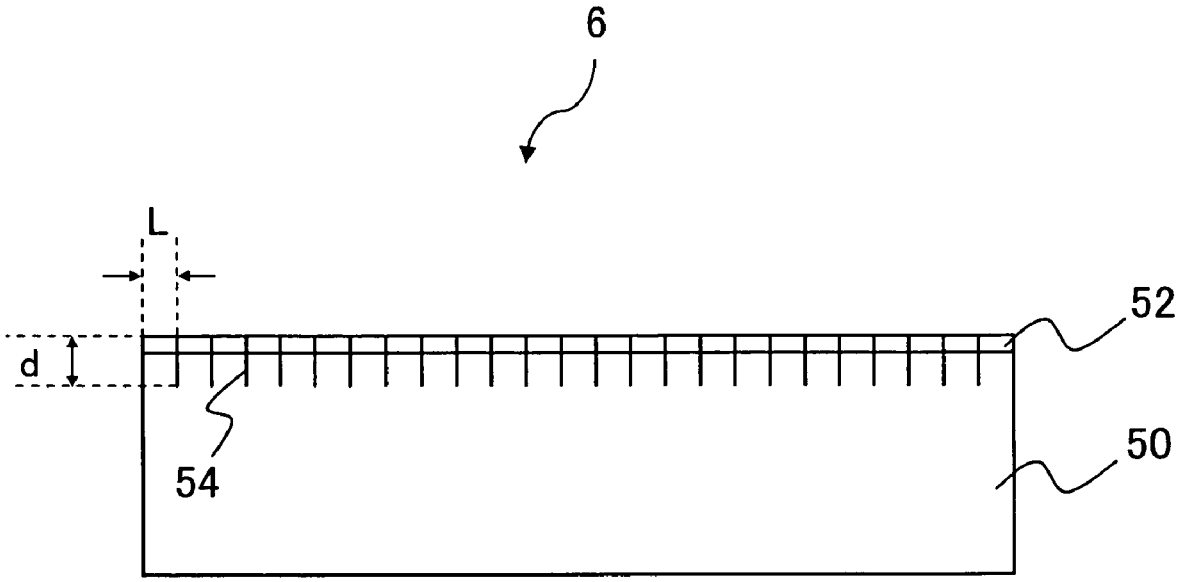
FIG. 3 is a diagram showing the cross-sectional structure of an example of an intermediate transfer belt according to an exemplary embodiment of the present invention.

FIG. 3 shows the cross-sectional structure of one example of the intermediate transfer belt 6 that is used as the intermediate transfer member in the image forming apparatus 1 according to an exemplary embodiment of the present invention. This intermediate transfer belt 6 has an elastic layer 50 and a surface layer 52. As shown in FIG. 3, the surface of the intermediate transfer belt 6 is partitioned by multiple slits 54. In other words, the surface of the intermediate transfer belt 6 is constructed so that multiple independent elastic bodies are grouped together to generate the appearance of a pseudo single surface.

In order to enable the use of an image forming apparatus that employs an intermediate transfer member to effect favorable toner transfer, with no transfer irregularities, to a large variety of recording sheets, and in particular to so-called embossed papers that include unevenness on the paper surface, the inventors of the present invention conceived of a method in which, in order to ensure that the intermediate transfer member may be able to adequately follow any indentations within the paper surface, the continuous nature of the surface of the elastic body of the intermediate transfer member, which is responsible for a deterioration in the following characteristics, is converted to a non-continuous form.

In other words, the position of the intermediate transfer member surface is regulated by protrusions on the paper surface, and the section of the intermediate transfer member that opposes an indentation adjacent to such a protrusion is affected by the position determined by this adjacent protrusion. Accordingly, the surface of the intermediate transfer member is partitioned, so that multiple independent elastic bodies are grouped together to form a pseudo single surface. As a result of this partitioning, those sections of the intermediate transfer member that oppose indentations in the paper may sit down within the indentations, irrespective of those sections of the intermediate transfer member that oppose protrusions in the paper. Furthermore, by widening the gap between independent elastic bodies, the independent elastic bodies may change position by essentially falling, meaning the ability of the intermediate transfer member to follow indentations may be enhanced even further. By adopting this type of intermediate transfer member, favorable transfer may be achieved with no transfer irregularities, even to so-called embossed papers that include unevenness within the paper surface.

The elastic layer 50 of the intermediate transfer belt 6 may employ a belt of an elastic material with favorable stretchiness such as chloroprene, urea rubber or silicone rubber, although from the perspective of cost and the like, the use of chloroprene is preferred. The Young's modulus for the elastic layer 50 is preferably within a range from about 1 to about 7 MPa, and is even more preferably from about 1.5 to about 5 MPa. If the Young's modulus exceeds about 7 MPa, then the ability of the layer to follow the indentations of an embossed paper may deteriorate, whereas if the Young's modulus is less than about 1 MPa, color shift may occur. The thickness of the elastic layer 50 is typically within a range from about 0.2 to about 0.7 μm.

The surface layer 52 is formed to prevent the adhesion of foreign matter such as toner to the surface of the elastic layer 50 of the intermediate transfer belt 6. The surface layer 52 is formed by dispersing a release agent such as PTFE (polytetrafluoroethylene) within a resin such as a urethane or acrylic resin. From the viewpoint of durability and the like, a layer formed by dispersing PTFE within a urethane resin is preferred. The thickness of this surface layer 52 is typically within a range from about 2 to about 20 μm.

The cut depth d of the slits 54 in the intermediate transfer belt 6 shown in FIG. 3 is preferably within a range from about 10 to about 100 μm, and even more preferably from about 30 to about 80 μm, from the surface of the surface layer 52. If this cut depth d is less than about 10 μm, then the ability of the intermediate transfer belt 6 to follow the indentations of an embossed paper may deteriorate, whereas if the depth exceeds about 100 μm, then foreign matter such as toner may penetrate into the depths of the slits 54, making removal difficult.

Figure 4:
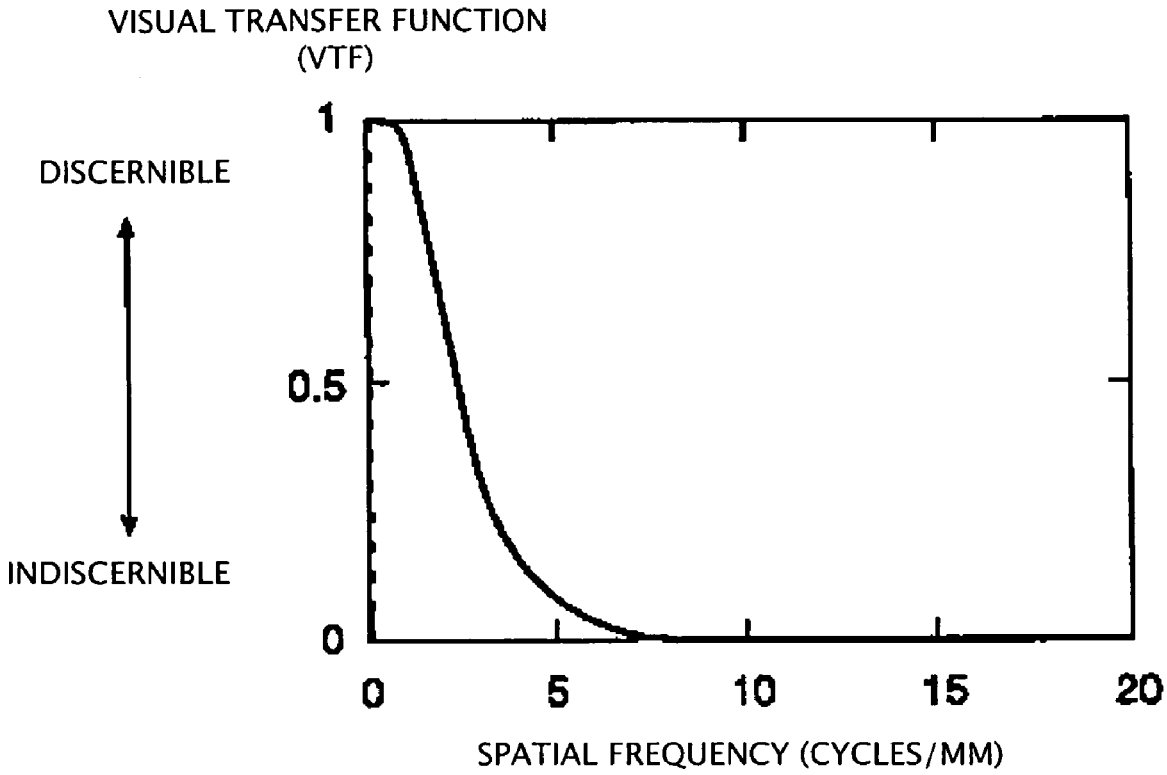
FIG. 4 is a graph showing the correlation between spatial frequency and human visual transfer function (VTF)

The cut pitch L between the slits 54 in the intermediate transfer belt 6 is preferably no more than about 200 μm, and even more preferably about 170 μm or less. If this cut pitch L exceeds about 200 μm, then transfer irregularities may become discernible to the human eye. A graph showing the correlation between spatial frequency and human visual transfer function (VTF) is shown in FIG. 4, and this graph shows that if the spatial frequency is set to at least about 5.9 (cycles/μm) (which corresponds with a cut pitch L of about 170 μm or less), then the result may be indiscernible to the human eye, and in practice, even a cut pitch L of about 200 μm presents no problems. Setting the cut pitch is no more than about 200 μm may ensure favorable following characteristics for any unevenness in the recording sheet, as well as ensuring that any transfer irregularities caused by the gaps between the independent elastic bodies may be visually indiscernible to the human eye.

Furthermore, the ratio d/L of the cut depth d relative to the cut pitch L for the slits 54 is preferably within a range from about 0.25 to about 1, and is even more preferably from about 0.3 to about 1. If the ratio d/L exceeds about 1, then the durability of the intermediate transfer belt 6 may deteriorate, whereas if the ratio is less than about 0.25, the ability of the intermediate transfer belt 6 to follow the indentations of an embossed paper may deteriorate.

In FIG. 3, the slits 54 are formed substantially perpendicularly to the surface of the intermediate transfer belt 6, but the slits 54 may also be formed in a diagonal direction, provided this does not impair the ability of the intermediate transfer belt 6 to follow indentations in the paper.

There are no particular restrictions on the method used for forming these slits 54 in the surface of the intermediate transfer belt 6, and suitable methods include a transfer molding method in which a press mold formed by photoetching is hot pressed onto the surface of the intermediate transfer belt 6, and methods that involve grinding of the belt surface.

Figure 5:
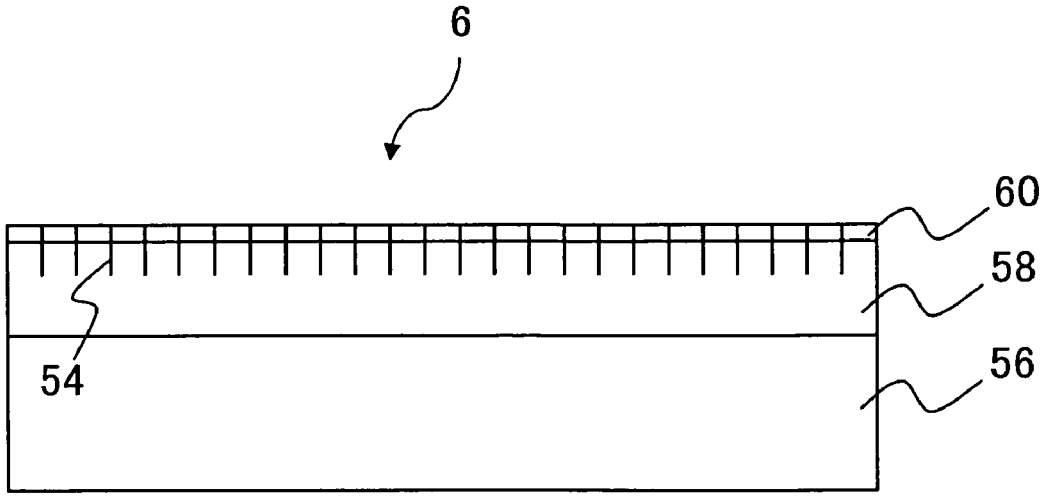
FIG. 5 is a diagram showing the cross-sectional structure of another example of an intermediate transfer belt according to an exemplary embodiment of the present invention.

As shown in FIG. 5, the intermediate transfer belt 6 may also be formed with a 3-layered structure that includes a base layer 56, an elastic layer 58, and a surface layer 60. In this case, once again the surface of the intermediate transfer belt 6 is partitioned by multiple slits 54.

The base layer 56 is formed including polyimides or polyamideimides or the like, and from the viewpoint of tensile modulus and the like, is preferably formed including a polyimide. The thickness of this base layer is typically within a range from about 50 to about 150 μm.

The elastic layer 58 is formed from an aforementioned elastic material and typically has a thickness within a range from about 0.05 to about 0.7 μm. The surface layer 60 is identical to the surface layer 52 described above.

In addition to an intermediate transfer belt that represents a belt-shaped intermediate transfer member, an intermediate transfer roller that uses a roller of the aforementioned elastic material as the elastic layer may also be used as the intermediate transfer member, although in terms of the paper transport properties, the degree of layout freedom and the like, an intermediate transfer belt is preferred.

Although partitioning the surface of this type of intermediate transfer member may enhance the ability of the member to follow indentations in the recording sheet, if foreign matter such as toner lodges in the gaps between the surface slits 54, then cleaning of the intermediate transfer member may become difficult. As a countermeasure to this potential problem, cleaning is preferably conducted at a section where the surface of the intermediate transfer member is stretched, and a curvature is applied to the belt in a direction that opens up the gaps. In other words, by ensuring that the curvature applied to the intermediate transfer member within the cleaning section is larger than the curvature applied during the secondary transfer, image contamination caused by foreign matter such as toner that has lodged in the gaps during the secondary transfer process may be effectively prevented.

In an exemplary embodiment of the present invention, in the primary transfer process where an image is transferred from the image carrier to the intermediate transfer member, the intermediate transfer member is preferably an intermediate transfer belt, and this intermediate transfer belt is preferably disposed so as to make contact along the surface of the image carrier. In other words, the intermediate transfer belt 6 of FIG. 1 is preferably imparted with a curvature so as to wrap around the photoreceptor drum 2 from a substantially flat planar arrangement. As a result, image defects caused by foreign matter such as toner entering the gaps between the independent elastic bodies during the primary transfer process may be prevented, and image deterioration caused by movement of the independent elastic bodies may be almost non-existent.

Figure 6:
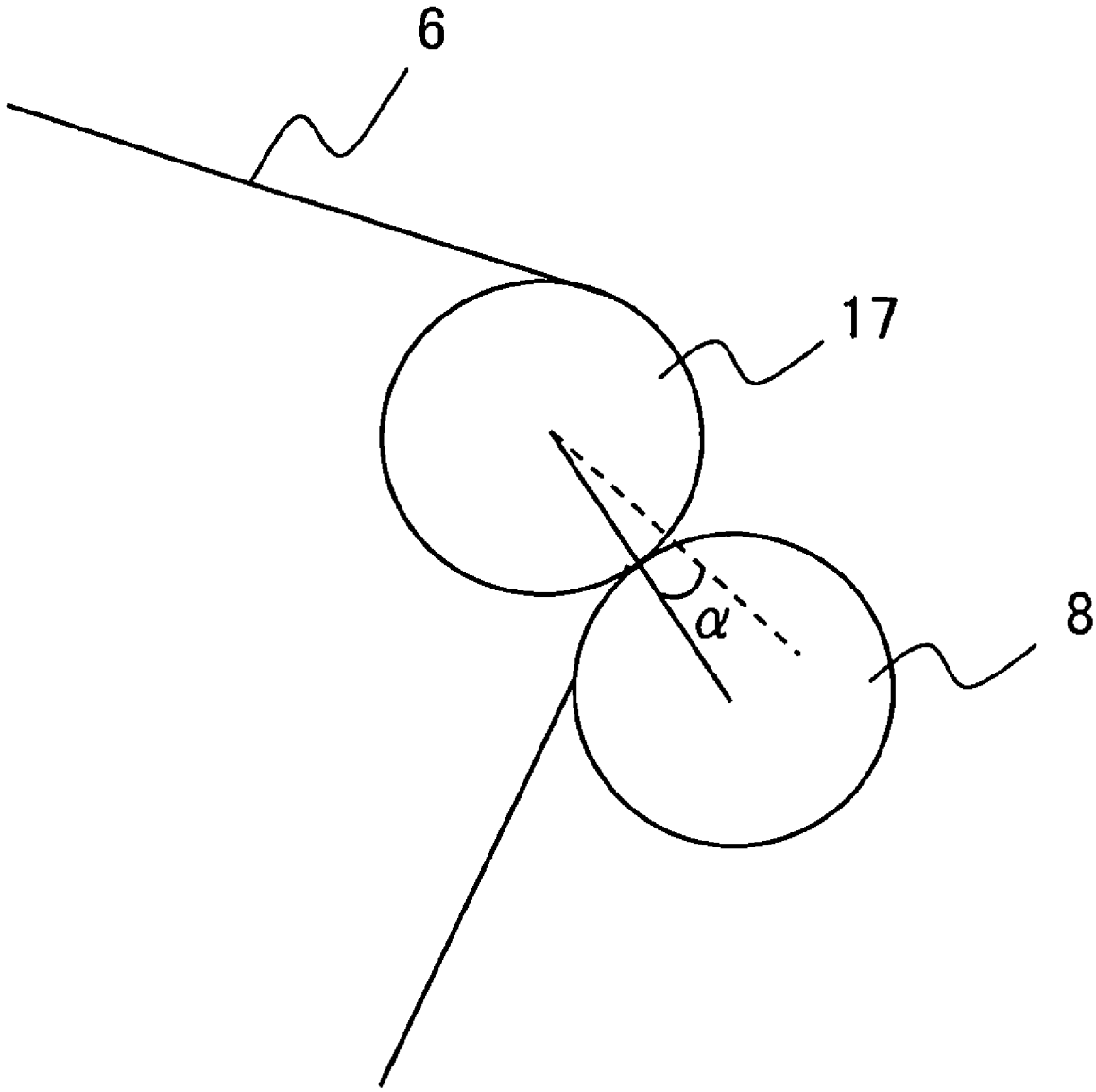
FIG. 6 is a diagram showing the positional relationship between a secondary transfer roller and an opposing backup roller in an image forming apparatus according to an exemplary embodiment of the present invention.

Furthermore, structures in which the intermediate transfer member is an intermediate transfer belt, a transfer roller is used during the secondary transfer process for transferring the image from the intermediate transfer member to the recording sheet, and the intermediate transfer belt is positioned so as to make contact around the surface of the transfer roller are preferred. In other words, at the initial contact position between the secondary transfer roller 8 and the intermediate transfer belt 6 in FIG. 1, the intermediate transfer belt 6 is preferably imparted with a curvature that causes the intermediate transfer belt 6 to wrap around the secondary transfer roller 8 from a substantially flat planar arrangement. In order to achieve such an arrangement, as shown in FIG. 6, the secondary transfer roller 8 is preferably positioned so as to contact the intermediate transfer belt 6 at a position equivalent to an upstream rotation through an angle $\alpha$=about 3 to about 20° from the position at which the opposing backup roller 17 makes contact. By adopting this configuration, image defects caused by foreign matter such as toner entering the gaps between the independent elastic bodies during the secondary transfer process may be prevented, and image deterioration caused by movement of the independent elastic bodies may be almost non-existent.

Furthermore, structures which include a cleaning unit that cleans the surface of the intermediate transfer belt, wherein the cleaning unit contains a cleaning member and an opposing member that opposes the cleaning member, and the intermediate transfer belt is positioned so as to male contact with the surface of the opposing member are preferred. In other words, in the cleaning device 18 used for cleaning unused toner from the intermediate transfer belt 6 shown in FIG. 1, the second cleaning backup roller 20 is preferably provided so as to impart a curvature to the portion of the intermediate transfer belt 6 facing the cleaning brush 25. This may ensure that during the cleaning process, any foreign matter lodged in the gaps between the independent elastic bodies may also be cleaned, meaning favorable stability may be maintained during repeated image formation.

In addition, the curvature of the intermediate transfer belt 6 at the opposing member is preferably greater than the curvature at the secondary transfer roller. In other words, the curvature of the intermediate transfer belt 6 generated by the second cleaning backup roller 20 in the cleaning device 18 in FIG. 1 is preferably greater than the curvature of the intermediate transfer belt 6 generated by the secondary transfer roller 8 during the secondary transfer to the recording sheet 9. By adopting this configuration, the gaps between the independent elastic bodies may be wider during the cleaning process than during the secondary transfer process, meaning favorable stability may be maintained during repeated image formation.

By employing a construction such as that described above, an image forming apparatus in which a toner image formed on the surface of an image carrier is transferred via an intermediate transfer member, and the intermediate transfer member used therein, may be able to achieve favorable image transfer, even to uneven papers such as embossed paper, may be able to prevent image defects and image deterioration, and may be able to maintain favorable stability during repeated image formation. In other words, with conventional intermediate transfer members, because of the continuous nature of the transfer surface, the following characteristics for very uneven recording sheets such as embossed papers is poor even if an elastic material is used, meaning image defects are likely to occur. However, by partitioning the transfer surface of the intermediate transfer member into multiple independent sections, thereby making the surface non-continuous, the ability of the intermediate transfer member to follow very uneven recording sheets may be improved, enabling favorable images to be obtained.

The photoreceptor drum 2 possesses at least a function for forming an electrostatic latent image (an electrostatically charged image). An electrophotographic photoreceptor is an ideal example of a material for the photoreceptor drum 2. An electrophotographic photoreceptor includes a coating containing an organic photoreceptor or the like formed on the outer periphery of a cylindrically shaped conductive substrate. The coating includes an undercoat layer where required, a photoreceptive layer that includes a charge generation layer containing a charge generating material and a charge transport layer containing a charge transporting material, and a surface layer (a surface protective layer) where required, with these layers formed sequentially in that order on top of a circular cylindrical substrate. The order of lamination of the charge generation layer and the charge transport layer may also be reversed. These configurations include a laminated photoreceptor in which the charge generating material and the charge transporting material are incorporated within separate layers (the charge generation layer and the charge transport layer), but a single layer photoreceptor in which the charge generating material and the charge transporting material are incorporated within a single layer is also possible, although a laminated photoreceptor is preferred. Furthermore, an intermediate layer may also be provided between the undercoat layer and the photoreceptive layer. Furthermore, the present invention is not restricted to organic photoreceptors, and other photoreceptive layers such as amorphous silicon photoreceptive films may also be used.

In a similar manner to conventional apparatus, the charging roller 3 is formed as a long roller that matches the entire image forming region of the photoreceptor drum 2. The charging roller 3 is pressed against the photoreceptor drum 2 with a predetermined pressure using an energizing unit such as a spring (not shown in the drawing) disposed on the shaft at both ends of the charging roller 3. The charging roller 3 is rotated by the rotation of the photoreceptor drum 2, and charges the surface of the photoreceptor drum 2 as it rotates. The charging roller 3 includes a shaft member formed from a metal material such as iron or stainless steel, with an integrated layer of an elastic body of a predetermined thickness provided around the periphery of that shaft member. The elastic body may use a conductive material such as EPDM rubber (ethylene-propylene rubber) with carbon or the like dispersed therein.

Following charging, imaging light (exposure light) that corresponds with image information is irradiated onto the surface of the photoreceptor drum 2 using the exposure device 4, causing the irradiated sections to undergo a decrease in electric potential. The imaging light is a light intensity distribution that corresponds with the black and white of the image, and irradiation of the imaging light forms an electric potential distribution on the surface of the photoreceptor drum 2, namely an electrostatic latent image, that corresponds with the image for recording.

There are no particular restrictions on the exposure device 4, and suitable examples include optical equipment such as laser optics systems and LED (light-emitting diode) arrays and the like that are capable of irradiating a desired image onto the surface of the photoreceptor drum 2 using a light source such as semiconductor laser light, LED light or liquid crystal shutter light.

The developing device 5 has the function of forming a toner image by developing the electrostatic latent image formed on the photoreceptor drum 2 using either a one-component developer or two-component developer containing an electrostatic latent image toner. There are no particular restrictions on the developing device provided it has the function described above, and the specific nature of the developing roller or developing device may be selected in accordance with the intended purpose. Either developing devices in which the toner layer contacts the photoreceptor drum 2, or developing devices in which no contact occurs are suitable. Examples of suitable developing devices include conventional developing units, such as developing units in which an electrostatic latent image developing toner is adhered to a photoreceptor drum using a developing roller, and developing units in which the toner is adhered to a photoreceptor drum using a brush or the like. A direct current voltage is usually used for the developer carrier, but an alternating current voltage may also be superimposed thereon.

There are no particular restrictions on the fixing unit 27, which may be any fixing unit capable of fixing the toner image transferred to the recording sheet 9 using heat, pressure, or a combination of heat and pressure.

The cleaning device 34 may be selected appropriately from blade cleaning systems, brush cleaning systems, and roller cleaning systems, provided the cleaning device is capable of cleaning any residual toner from the surface of the photoreceptor drum 2. Of these systems, the use of a cleaning blade is preferred. Furthermore, suitable materials for the cleaning blade include urethane rubber, neoprene rubber, and silicone rubber. Of these, the use of polyurethane elastomers is particularly preferred as they offer superior abrasion resistance. If a toner with very high transfer efficiency is used, then an apparatus that does not employ a cleaning device 34 is also possible.

The recording sheet 9 that functions as the transfer target to which the toner image is transferred may employ any of a variety of materials, including normal paper used in electrophotographic copying machines or printers or the like, OHP (overhead projector) sheets, embossed papers with uneven surfaces (uneven papers), coated papers in which the surface of a normal paper is coated with a resin or the like, and art papers used for printing. In an image forming apparatus according to an exemplary embodiment of the present invention, the structure described above may provide excellent following characteristics for the indentations within embossed papers. As a result, even if an embossed paper is used as the recording sheet 9, almost no gap develops between the paper and the surface of the intermediate transfer member at the paper indentations, meaning the problem of electrical discharge causing the toner formed on the surface of the intermediate transfer member to develop an inverse charge, resulting in unsatisfactory transfer, may be prevented. Particularly in systems that use an intermediate transfer member, the toner that is initially transferred during the primary transfer process gradually accumulates more charge as a result of transfer field effects and electrical discharge, meaning a large electric field is then required in the secondary transfer process to transfer this highly charged toner, but in an image forming apparatus according to an exemplary embodiment of the present invention, unsatisfactory transfer to uneven paper may be still almost entirely non-existent.

In this description, the term "embossed paper" refers to special paper with unevenness formed within the paper surface, and in particular, refers to recording paper of thickness about 100 to about 260 μm in which the degree of surface unevenness is within a range from about 40 to about 60 μm. An example of this type of embossed paper is "Leathac", which is available from Fuji Xerox Office Supply Co., Ltd., for example as "Leathac 66 (151 g/m$^2$)". Furthermore, the term "normal paper" typically refers to paper with a degree of surface unevenness of approximately 10 μm.

EXAMPLES

As follows is a more detailed description of the present invention based on a series of examples and comparative examples, although the present invention is in no way limited by the examples presented below.

Using the image forming apparatus 1 shown in FIG. 1 and FIG. 2 (DocuPrint C525 A, manufactured by Fuji Xerox Co., Ltd.), image formation is conducted using a variety of different recording sheets, and the transferability and the stability during repeated image formation are evaluated.

Example 1

As the intermediate transfer belt 6, a two-layered structure such as that shown in FIG. 3 is used, wherein the elastic layer 50 is an elastic belt of thickness 0.55 μm formed from chloroprene with a Young's modulus of 3 MPa, and a fluorine-based coating layer (the surface layer 52) of thickness 3 μm is formed on the surface of the elastic layer 50. Furthermore, slits 54 are formed to a depth of 70 μm (the cut depth d) from the surface of the intermediate transfer belt 6 in a square lattice pattern with a spacing of 200 μm (the cut pitch L) (ratio of the cut depth d relative to the cut pitch L: d/L=0.35). The slits 54 are formed by transfer molding, by hot pressing a press mold formed by photoetching onto the surface of the intermediate transfer belt 6. The Young's modulus of the elastic layer 50 is measured at room temperature (22° C., 55% RH) using a tensile tester (Strograph VE5D, manufactured by Toyo Seiki Seisaku-sho, Ltd.). The cut depth d and the cut pitch L of the intermediate transfer belt 6 is measured by inspecting the surface and a cross-section of the intermediate transfer belt using a measuring microscope (MM-60, manufactured by Nikon Corporation).

In these examples, as shown in FIG. 1, the primary transfer unit for transferring an image from the photoreceptor drum 2 to the intermediate transfer belt 6 is formed by imparting the intermediate transfer belt 6 with a curvature that causes the intermediate belt to wrap around the photoreceptor drum 2. This configuration causes a narrowing of the gaps between the independent elastic bodies of the intermediate transfer belt 6, thereby preventing foreign matter such as toner from entering the gaps.

The secondary transfer unit for transferring the toner image from the intermediate transfer belt 6 to the recording sheet 9 uses a transfer roller produced by forming a urethane foam body around the periphery of a shaft as the secondary transfer roller 8, and as shown in FIG. 6, the secondary transfer roller 8 is positioned so as to contact the intermediate transfer belt 6 at a position equivalent to an upstream rotation through an angle $\alpha$=12° from the position at which the opposing backup roller 17 makes contact. This configuration enables the secondary transfer to be conducted with the gaps between the independent elastic bodies narrowed, meaning that in a similar manner to the primary transfer process, foreign matter such as toner may be prevented from entering the gaps.

The cleaning device 18 for the intermediate transfer belt 6 includes the first cleaning backup roller 19, the scraper 24 that is positioned so as to contact the surface of the intermediate transfer belt 6, the second cleaning backup roller 20, and the cleaning brush 25 that opposes the second cleaning backup roller 20 across the intermediate transfer belt 6. The cleaning brush 25 is rotationally driven and is biased with the opposite polarity to the residual transfer toner. In the cleaning device 18, because the intermediate transfer belt 6 runs around the surface of the second cleaning backup roller 20, the gaps between the independent elastic bodies are widened. This configuration facilitates the removal of any foreign matter such as toner that has lodged in the gaps between the independent elastic bodies.

The results of using the configuration described above to print a 3-color image in which the yellow (Y), magenta (M) and cyan (C) toners are superimposed and a half-tone image are shown in Table 1. The print results following continuous printing of 1,000 copies are shown in Table 2. The results in Table 2 indicate the sustainability of the print performance. The recording sheets used include an embossed paper ("Leathac 66" (surface unevenness: 80 μm, 151 g/m$^2$), manufactured by Fuji Xerox Office Supply Co., Ltd.), a normal paper ("P-paper" (surface unevenness: 10 μm, 64 g/m$^2$), manufactured by Fuji Xerox Office Supply Co., Ltd.), and a coated paper ("J-coated paper" (surface unevenness: 2 μm, 95 g/m$^2$), manufactured by Fuji Xerox Office Supply Co., Ltd.). Transferability is evaluated against the following criteria.

Excellent: favorable density and uniformity

Good: some uniformity irregularities and color mixing are evident

Poor: poor density and uniformity

Example 2

With the exception of using a configuration in which, during the primary transfer process, the intermediate transfer belt 6 adopts the opposite curvature to that required to wrap around the surface of the photoreceptor drum 2, image formation tests and subsequent evaluations are conducted in the same manner as example 1. The results are shown in Table 1 and Table 2.

Example 3

With the exception of using a configuration in which the secondary transfer roller 8 is positioned directly above the backup roller 17, image formation tests and subsequent evaluations are conducted in the same manner as example 1. The results are shown in Table 1 and Table 2.

Example 4

With the exception of using a configuration in which, during the cleaning process, cleaning using the cleaning brush 25 is conducted at a position separated from the second cleaning backup roller 20, image formation tests and subsequent evaluations are conducted in the same manner as example 1. The results are shown in Table 1 and Table 2.

Example 5

With the exception of altering the cut pitch L of the slits 54 in the surface of the intermediate transfer belt 6 to 400 μm (d/L=0.175), image formation tests and subsequent evaluations are conducted in the same manner as example 1. The results are shown in Table 1 and Table 2.

Example 6

With the exception of altering the cut depth d of the slits 54 in the surface of the intermediate transfer belt 6 to 100 μm (d/L=0.5), image formation tests and subsequent evaluations are conducted in the same manner as example 1. The results are shown in Table 1 and Table 2.

Example 7

With the exception of altering the cut depth d of the slits 54 in the surface of the intermediate transfer belt 6 to 10 μm (d/L=0.05), image formation tests and subsequent evaluations are conducted in the same manner as example 1. The results are shown in Table 1 and Table 2.

Example 8

With the exception of altering the cut depth d of the slits 54 in the surface of the intermediate transfer belt 6 to 250 μm (d/L=1.25), image formation tests and subsequent evaluations are conducted in the same manner as example 1. The results are shown in Table 1 and Table 2.

Example 9

With the exception of altering the cut depth d of the slits 54 in the surface of the intermediate transfer belt 6 to 5 μm (d/L=0.025), image formation tests and subsequent evaluations are conducted in the same manner as example 1. The results are shown in Table 1 and Table 2.

Comparative Example 1

With the exception of not forming any slits 54 in the surface of the intermediate transfer belt 6, image formation tests and subsequent evaluations are conducted in the same manner as example 1. The results are shown in Table 1 and Table 2.

TABLE 1

| | Young's modulus [MPa] | Cut depth d [μm] | Cut pitch L [μm] | d/L | Image | Embossed paper | Normal paper | Coated paper | Notes |
|---|---|---|---|---|---|---|---|---|---|
| Example 1 | 30 | 70 | 200 | 0.35 | 3-color | Excellent | Excellent | Excellent | |
| | | | | U.S.C. § | superimposed | | | | |
| | | | | | half-tone | Excellent | Excellent | Excellent | |
| Example 2 | 30 | 70 | 200 | 0.35 | 3-color | Excellent | Excellent | Excellent | *1 |
| | | | | U.S.C. § | superimposed | | | | |
| | | | | | half-tone | Excellent | Excellent | Excellent | |
| Example 3 | 30 | 70 | 200 | 0.35 | 3-color | Excellent | Excellent | Excellent | *2 |
| | | | | U.S.C. § | superimposed | | | | |
| | | | | | half-tone | Excellent | Excellent | Excellent | |
| Example 4 | 30 | 70 | 200 | 0.35 | 3-color | Excellent | Excellent | Excellent | *3 |
| | | | | U.S.C. § | superimposed | | | | |
| | | | | | half-tone | Excellent | Excellent | Excellent | |
| Example 5 | 30 | 70 | 400 | 0.175 | 3-color | Excellent | Excellent | Excellent | |
| | | | | | superimposed | | | | |
| | | | | | half-tone | Good | Good | Good | |
| Example 6 | 30 | 100 | 200 | 0.5 | 3-color | Excellent | Excellent | Excellent | |
| | | | | | superimposed | | | | |
| | | | | | half-tone | Excellent | Excellent | Excellent | |
| Example 7 | 30 | 10 | 200 | 0.05 | 3-color | Excellent | Excellent | Excellent | |
| | | | | | superimposed | | | | |
| | | | | | half-tone | Good | Excellent | Excellent | |
| Example 8 | 30 | 250 | 200 | 1.25 | 3-color | Excellent | Excellent | Excellent | |
| | | | | | superimposed | | | | |
| | | | | | half-tone | Excellent | Excellent | Excellent | |

TABLE 1-continued

| | Young's modulus [MPa] | Cut depth d [μm] | Cut pitch L [μm] | d/L | Image | Embossed paper | Normal paper | Coated paper | Notes |
|---|---|---|---|---|---|---|---|---|---|
| Example 9 | 30 | 5 | 200 | 0.025 | 3-color superimposed | Good | Excellent | Excellent | |
| | | | | | half-tone | Good | Excellent | Excellent | |
| Comparative example 1 | 30 | — | — | — | 3-color superimposed | Good | Excellent | Excellent | |
| | | | | | half-tone | Poor | Excellent | Excellent | |

*1: Configuration in which the intermediate transfer belt 6 adopts the opposite curvature to that required to wrap around the surface of the photoreceptor drum 2.
*2: Configuration in which the secondary transfer roller 8 is positioned directly above the backup roller 17.
*3: Configuration in which cleaning using the cleaning brush 25 is conducted at a position separated from the second cleaning backup roller 20.

TABLE 2

| | Young's modulus [MPa] | Cut depth d [μm] | Cut pitch L [μm] | d/L | Image | Embossed paper | Normal paper | Coated paper | Notes |
|---|---|---|---|---|---|---|---|---|---|
| Example 1 | 30 | 70 | 200 | 0.35 | 3-color superimposed | Excellent | Excellent | Excellent | |
| | | | | | half-tone | Excellent | Excellent | Excellent | |
| Example 2 | 30 | 70 | 200 | 0.35 | 3-color superimposed | Excellent | Excellent | Excellent | *1 |
| | | | | | half-tone | Excellent | Excellent | Good | |
| Example 3 | 30 | 70 | 200 | 0.35 | 3-color superimposed | Excellent | Excellent | Excellent | *2 |
| | | | | | half-tone | Good | Good | Good | |
| Example 4 | 30 | 70 | 200 | 0.35 | 3-color superimposed | Excellent | Excellent | Excellent | *3 |
| | | | | | half-tone | Excellent | Excellent | Good | |
| Example 5 | 30 | 70 | 400 | 0.175 | 3-color superimposed | Excellent | Excellent | Excellent | |
| | | | | | half-tone | Good | Good | Good | |
| Example 6 | 30 | 100 | 200 | 0.5 | 3-color superimposed | Excellent | Excellent | Excellent | |
| | | | | | half-tone | Excellent | Excellent | Excellent | |
| Example 7 | 30 | 10 | 200 | 0.05 | 3-color superimposed | Excellent | Excellent | Excellent | |
| | | | | | half-tone | Good | Excellent | Excellent | |
| Example 8 | 30 | 250 | 200 | 1.25 | 3-color superimposed | Excellent | Excellent | Excellent | |
| | | | | | half-tone | Good | Good | Good | |
| Example 9 | 30 | 5 | 200 | 0.025 | 3-color superimposed | Good | Excellent | Excellent | |
| | | | | | half-tone | Good | Excellent | Excellent | |
| Comparative example 1 | 30 | — | — | — | 3-color superimposed half-tone | | | | |

*1: Configuration in which the intermediate transfer belt 6 adopts the opposite curvature to that required to wrap around the surface of the photoreceptor drum 2.
*2: Configuration in which the secondary transfer roller 8 is positioned directly above the backup roller 17.
*3: Configuration in which cleaning using the cleaning brush 25 is conducted at a position separated from the second cleaning backup roller 20.

As shown in Table 1, the examples 1 to 9 exhibit favorable transfer to embossed paper, which has conventionally proven difficult. In contrast, in the comparative example 1, the transferability to embossed paper is significantly inferior. Furthermore, as shown in Table 2, compared with the case in which the curvature is reversed in the primary transfer process (the example 2), the case in which the secondary transfer roller 8 is positioned directly above the backup roller 17 during the secondary transfer process (the example 3), and the case in which the cleaning process is conducted at a position separated from the second cleaning backup roller 20 (meaning the gaps between the independent elastic bodies are narrowed) (the example 4), the example 1 exhibits almost no image contamination, and may be able to retain favorable image quality over an extended period.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an image carrier on which a toner image is formed, a charging unit that charges a surface of the image carrier, a latent image processing unit that forms a latent image on the surface of the image carrier, a developing unit that develops the latent image using a toner, thereby forming a toner image, a primary transfer unit that conducts a primary transfer of the toner image to an intermediate transfer member, and a secondary transfer unit that conducts a secondary transfer of the toner image that has been transferred to the intermediate transfer member to a transfer target, wherein a surface of the intermediate transfer member is partitioned by a plurality of slits formed in a square lattice pattern.

2. The image forming apparatus according to claim 1, wherein a cut pitch between the plurality of slits is no more than about 200 mm.

3. The image forming apparatus according to claim 1, wherein a cut depth of the plurality of slits is within a range from about 10 to about 100 mm.

4. The image forming apparatus according to claim 1, wherein a ratio of a cut depth of the plurality of slits relative to a cut pitch between the plurality of slits (depth/pitch) is within a range from about 0.25 to about 1.0.

5. The image forming apparatus according to claim 1, wherein the intermediate transfer member is an intermediate transfer belt, which is disposed so as to make contact along the surface of the image carrier.

6. The image forming apparatus according to claim 5, wherein the secondary transfer unit comprises a transfer roller, and the intermediate transfer belt is disposed so as to make contact around a surface of the transfer roller.

7. The image forming apparatus according to claim 6, wherein a curvature of the intermediate transfer belt at the surface of the opposing member is larger than a curvature of the intermediate transfer belt at a surface of the transfer roller.

8. The image forming apparatus according to claim 5, further comprising a cleaning unit that cleans a surface of the intermediate transfer belt, wherein the cleaning unit comprises a cleaning member and an opposing member that opposes the cleaning member, and the intermediate transfer belt is disposed so as to contact a surface of the opposing member.

9. The image forming apparatus according to claim 8, wherein the cleaning member is a cleaning brush.

10. An intermediate transfer member, which is used in an image forming apparatus that transfers a toner image formed on a surface of an image carrier to a transfer target via the intermediate transfer member, wherein a surface of the intermediate transfer member is partitioned by a plurality of slits formed in a square lattice pattern.

11. The intermediate transfer member according to claim 10, wherein a cut pitch between the plurality of slits is no more than about 200 mm.

12. The intermediate transfer member according to claim 10, wherein a cut depth of the plurality of slits is within a range from about 10 to about 100 mm.

13. The intermediate transfer member according to claim 10, wherein a ratio of a cut depth of the plurality of slits relative to a cut pitch between the plurality of slits (depth/pitch) is within a range from about 0.25 to about 1.0.

14. An intermediate transfer member, which is used in an image forming apparatus that transfers a toner image formed on a surface of an image carrier to a transfer target via the intermediate transfer member, wherein a surface of the intermediate transfer member is partitioned by a plurality of slits so that multiple independent elastic bodies are grouped together to form a pseudo single surface.

15. The intermediate transfer member according to claim 14, wherein a cut pitch between the plurality of slits is no more than about 200 mm.

16. The intermediate transfer member according to claim 14, wherein a cut depth of the plurality of slits is within a range from about 10 to about 100 mm.

17. The intermediate transfer member according to claim 14, wherein a ratio of a cut depth of the plurality of slits relative to a cut pitch between the plurality of slits (depth/pitch) is within a range from about 0.25 to about 1.0.

* * * * *